United States Patent [19]

Sperber et al.

[11] Patent Number: 4,918,478

[45] Date of Patent: Apr. 17, 1990

[54] TANK WITH RACK FOR WET PROCESSING PHOTOGRAPHIC MATERIAL

[75] Inventors: Werner Sperber, Munich; Harald Fengler, Taufkirchen; Wilfried Hehn, Munich, all of Fed. Rep. of Germany

[73] Assignee: Agfa-Gevaert Aktiengesellschaft, Leverkusen, Fed. Rep. of Germany

[21] Appl. No.: 392,643

[22] Filed: Aug. 11, 1989

[30] Foreign Application Priority Data

Aug. 25, 1988 [DE] Fed. Rep. of Germany ..... 8810735

[51] Int. Cl.[4] ..... G03D 3/08

[52] U.S. Cl. ..... 354/320; 354/321; 354/325; 354/339

[58] Field of Search ..... 354/320, 321, 322, 338, 354/339, 325

[56] References Cited

U.S. PATENT DOCUMENTS

| | | | |
|---|---|---|---|
| 4,708,453 | 11/1987 | Fryda et al. | 354/320 |
| 4,760,416 | 7/1988 | Hehn | 354/320 |
| 4,837,593 | 6/1989 | Hehn | 354/322 |

*Primary Examiner*—A. A. Mathews

*Attorney, Agent, or Firm*—Peter K. Kontler

[57] ABSTRACT

A tank for the wet processing of photographic material has a container mounted on the inside of one of its walls. The container communicates with a source of processing liquid and has at least one nozzle for spraying the liquid against photographic material being conveyed through the tank. The nozzle defines a constriction in the tank and an enlargement is present below the constriction. A movable rack has several pairs of rolls which serve to advance the photographic material through the tank, and one or more sheet-like guides for directing the photographic material to the nips of the rolls. At least one such guide is located below the constriction when the rack is mounted on the tank in working position and a portion of this guide is then disposed in the enlargement. To prevent the guide from catching on the nozzle upon removal of the rack from the tank, the guide is mounted on the rack for pivotal movement between an inoperative position and an operative position. In the inoperative position, the guide is pivoted towards the interior of the rack so that it can pass by the constriction and is unable to provide guidance for photographic material. In the operative position, the guide is pivoted towards the exterior of the rack and is capable of directing photographic material along the latter. A spring normally urges the guide to its inoperative position.

16 Claims, 2 Drawing Sheets

TANK WITH RACK FOR WET PROCESSING PHOTOGRAPHIC MATERIAL

BACKGROUND OF THE INVENTION

The invention relates generally to an arrangement for processing photosensitive material.

More particularly, the invention relates to an arrangement of the type which is used in the wet processing of running lengths of photographic material and includes a treatment tank or vessel as well as a rack designed to be removably mounted in the tank. The rack defines a path for the photographic material and comprises a pair of rolls for drawing the photographic material into the path, additional rolls for transporting the photographic material along the path and guides of sheet material. The tank has a constriction which is parallel to the rolls when the rack is mounted in the tank, extends over the entire length of the rolls and is located beneath the rolls serving to draw the photographic material into the path defined by the rack.

Such a tank is shown in the West German Pat. No. 36 14 253. This tank has an enlargement below the constriction and, in order that the transporting rolls may be introduced into the enlargement, the rack is constructed in two parts. The lower part of the rack can then be passed through the constriction by tilting the same.

If, for whatever reason, it is desired to use a one-piece rack, the transporting rolls cannot project into the enlarged portion of the tank below the constriction. However, a guide surface is then required to guide the photographic material through the constricted location and directly to a centrally positioned, lower pair of deflecting rolls. When such a guide surface is provided on the rack in a conventional manner, it can interfere with introduction of the rack into the tank. This is particularly true when a portion of the constriction is formed by a protuberance such as, for example, a downwardly inclined slotted nozzle.

OBJECTS AND SUMMARY OF THE INVENTION

It is an object of the invention to simplify insertion of a path defining means into and removal of the same from a treatment vessel for photosensitive material.

Another object of the invention is to provide an arrangement which allows a one-piece path defining means to be introduced into and removed from a treatment vessel for photosensitive material relatively easily while still permitting good guidance of the photosensitive material to be achieved.

An additional object of the invention is to provide an arrangement which enables a one-piece path defining means to be inserted in and removed from a treatment vessel for photosensitive material without difficulty even when the vessel has an internal constriction.

A further object of the invention is to improve an arrangement including a tank and a rack of the type described above in such a manner that even a one-piece rack can be introduced into and withdrawn from the tank without difficulty in spite of internal constriction of the tank and while still allowing good guidance of photosensitive material to be achieved.

It is also an object of the invention to provide a simplified method of operating an arrangement used in the processing of photosensitive material and including a treatment vessel as well as a path defining means which can be removably mounted in the vessel.

The preceding objects, as well as others which will become apparent as the description proceeds, are achieved by the invention.

One aspect of the invention resides in an arrangement for processing photosensitive material, particularly for wet processing running lengths of photographic material. The arrangement comprises a treatment tank or vessel for the photosensitive material, as well as means defining a path for the photosensitive material and designed to be removably mounted in the vessel. The path defining means, which is hereinafter also referred to as a rack, includes a support and a guide mounted on the support for movement between an inoperative position and an operative position in which the guide is arranged to guide the photosensitive material along the path. It is preferred for the guide to be mounted on the support for pivotal movement between the inoperative and operative positions. Means is provided to urge the guide to the inoperative position and preferably includes one or more springs. Cooperating first and second means are disposed on the guide and in the vessel, respectively, and function to move the guide from the inoperative to the operative position upon insertion of the support in the vessel. The first means advantageously includes an inclined surface on the guide while the second means preferably includes a control surface which is arranged in the vessel so as to abut the inclined surface when the support is introduced into the vessel.

The arrangement may further comprise means defining a constriction in the vessel and the latter may have an enlargement beyond the constriction. At least a portion of the guide may be situated in the enlargement when the support is mounted in the vessel and the first and second means are then advantageously arranged to move the guide from the inoperative to the operative position after such portion of the guide has cleared the constriction. The guide may be made of sheet material.

The path defining means or rack may include transporting rolls which are again mounted on the support and the guide may be shifted towards these rolls in the inoperative position and away from the rolls in the operative position. The rack may further include a pair of rolls on the support for drawing the photosensitive material into the path defined by the path defining means.

The constriction and the rolls may be elongated, and the vessel and the rack may be designed in such a manner that the constriction and the rolls extend generally parallel to one another when the support is mounted in the vessel. The constriction may extend along the entire length of the rolls, that is, the constriction may have a length at least equal to that of the rolls. The pair of rolls which draws the photosensitive material into the path defined by the rack will normally be located before the constriction when the support is mounted in the vessel.

The treatment vessel may have an upright orientation and may be designed such that the rack is inserted in and removed from the vessel through the upper end of the latter. A container for treatment fluid may be disposed in the vessel and the upper end of this container may form the constriction The container may be provided with one or more nozzles for spraying or otherwise admitting the treatment fluid into the vessel and the nozzle or nozzles are preferably disposed adjacent to the upper end of the container. The first and second means for moving the guide are here advantageously arranged to shift the guide from the inoperative to the operative position after the guide has cleared the nozzle or nozzles.

The novel features which are considered as characteristic of the invention are set forth in particular in the appended claims. The improved processing arrangement itself, however, both as to its construction and its mode of operation, together with additional features and advantages thereof, will be best understood upon perusal of the following detailed description of certain specific embodiments when read in conjunction with the accompanying drawings.

DESCRIPTION OF THE PREFERRED EMBODIMENTS

Figure 1:
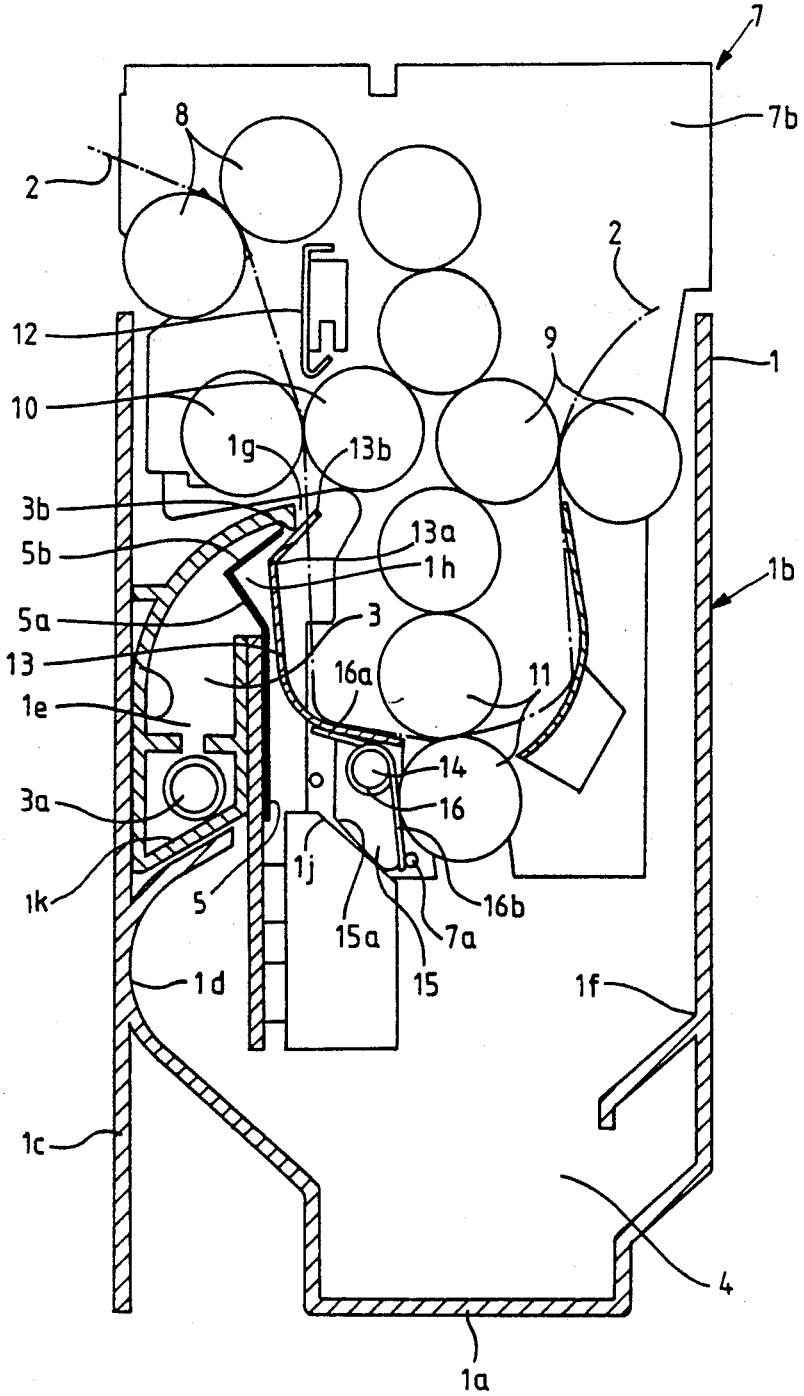
FIG. 1 is a transverse sectional view of a processing arrangement in accordance with the invention and including a treatment tank as well as a rack.

FIG. 1 illustrates an arrangement according to the invention for the wet processing of running lengths of photographic material 2. The arrangement includes an upright treatment tank or vessel 1 which accommodates a bath for treatment of the photographic material 2. The tank 1 has a longitudinal bottom wall 1*a* and a pair of opposed longitudinal side walls 1*b* and 1*c*. The lower part of the side wall 1*b* is provided with a flange which projects downwards into the interior of the tank 1 so that an enlargement 1*f* is formed in the tank 1 above the flange. The lower part of the side wall 1*c* is formed with a hollow which faces the interior of the tank 1 thereby causing a second enlargement 1*d* to be present in the tank 1. The enlargements 1*d* and 1*f* are located at approximately the same level of the tank 1.

A container 3 which may, for example, serve to conduct a treating liquid into the tank 1, is disposed in the interior of the tank 1. The container 3, which extends longitudinally of the tank 1, is separated from the interior of the tank 1 along the length of the latter by walls 1*e* and 1*k* mounted on the upper part of the side wall 1*c* at the inner side thereof. The container walls 1*e* and 1*k* project upwards into the interior of the tank 1 and thus constrict the same.

The tank 1 further has a pair of opposed transverse end walls 4 of which only one is visible in FIG. 1. The end walls 4, which are essentially mirror symmetrical, consist of flat supporting and sealing plates which may project beyond the sides of the tank 1 in order to increase the stability of the latter.

As already mentioned, the tank 1 is formed with enlargements 1*d* and 1*f* and is constricted between the wall 1*b* thereof and the walls 1*e*,1*k* of the container 3. The constricted area between the wall 1*b* of the tank 1 and the walls 1*e*,1*k* of the container 3 makes it difficult to place transporting rolls for the photographic material 2 to be treated in the region of the bottom wall 1*a* of the tank 1. Such lower transporting rolls must be mounted in the tank 1 in one of two ways. They must either be removably journalled directly on the end walls 4 or journalled on a rack segment which can be displaced through the constricted area by tilting and then set down on the bottom wall 1*a* of the tank 1.

An intake nipple 3*a* opens into the container 3 and allows treating liquid to be drawn into the same by means of a non-illustrated pump. A spray nozzle 3*b* may be formed at the free upper end of the container wall 1*e* which faces the interior of the tank 1. The spray nozzle 3*b*, which serves to discharge treating liquid from the container 3 against the running photographic material 2, may have an outlet opening on the form of an elongated slit which extends across the full width of the path followed by the photographic material 2. In the embodiment illustrated in FIG. 1, the upper edge of the container wall 1*k* is disposed well below the free upper end of the container wall 1*e* so that a broad gap is defined at the upper end of the container 3. A constricting element 5 of sheet material is mounted at the inner side of the container wall 1*k* and extends upwards across the gap. The constricting element 5 closes the gap with the exception of a narrow slit which is located adjacent to the free upper end of the container wall 1*e* and constitutes the outlet opening of the spray nozzle 3*b*. The free upper end of the container wall 1*e* projects into the interior of the tank 1 farther than the container wall 1*k*. Furthermore, the portion of the constricting element 5 located in the gap between the container walls 1*e* and 1*k* has the cross-sectional outline of an arrowhead 5*a*,5*b* pointing towards the exterior of the tank 1. The free upper end of the arrowhead 5*a*,5*b*, which confronts the free upper end of the container wall 1*e* and cooperates therewith to form the spray nozzle 3*b*, projects into the interior of the tank 1 to a lesser extent than such end of the container wall 1*e*. By virtue of this arrangement and the design of the free upper end of the container wall 1*e*, the spray nozzle 3*b* is directed downwards into the interior of the tank 1. Moreover, a small enlargement 1*h* is formed below the spray nozzle 3*b*.

The spray nozzle 3*b* and the free upper end of the container wall 1*e* define an elongated constriction 1*g* internally of the tank 1. The cross-sectional area of the tank 1 at the constriction 1*g* is smaller than the cross-sectional area at any other location between the upper end of the tank 1 and the enlargements 1*d* and 1*f*.

The gap between the upper edge of the container wall 1*k* and the free upper end of the container wall 13 may be eliminated so that the upper end of the container 3 is closed. The spray nozzle 3*b* with the single slit-like outlet opening may then be replaced by a series of discrete spray nozzles which are constituted by respective apertures formed in the container wall 1*k* or 1*e*. Such apertures may be arranged in a row which extends across the entire width of the path taken by the photographic material 2.

For various reasons, e.g., cost considerations or the need for a short path due to the process to be used, it may be necessary to employ a single one-piece rack in the tank 1. Such a rack, which is generally identified by the reference numeral 7 in FIGS. 1 and 2, constitutes a means which defines a path for the photographic material 2. The rack 7 is designed to be removably mounted in the tank 1 and is inserted in and removed from the tank 1 via the upper end of the latter The rack 7 includes a pair of end walls 7*b* which together constitute a support. The support 7*b* carries a pair of entry rolls 8 which serve to draw the photographic material 2 into the path defined by the rack 7 and a pair of exit rolls 9 which function to convey the photographic material 2 out of such path. The path defined by the rack 7 has a first portion which extends from the entry rolls 8 to the lower end of the rack 7 and a second portion which extends from the lower end of the rack 7 to the exit rolls 9. The photographic material 2 travels downwards in the first portion of the path and upwards in the second portion thereof. A pair of deflecting rolls 11 is disposed at the lower end of the rack 7 between the first and second portions of the path and the deflecting rolls 11 serve to conduct the photographic material 2 from the first into the second portion of the path and to change the direction of travel of the photographic material. The deflecting rolls 11 are again journalled on the support 7*b*. In addition, a pair of transporting rolls 10 may be mounted on the support 7*b* along the first portion of the path defined by the rack 7, that is, between the inlet rolls 8 and the deflecting rolls 11. To assure that the photographic material 2 actually enters the nip of the deflecting rolls 11, the support 7*b* further carries a guide 12 of sheet material as well as a guide 13 of sheet material The guide 13 is located along the first portion of the path defined by the rack 7 and is situated between the transporting rolls 10 and the deflecting rolls 11.

The constriction 1*g* extends longitudinally of the tank 1 and the rack 7 is designed to be mounted in the tank 1 such that the rolls 8, 9, 10 and 11 likewise extend longitudinally of the tank 1. Thus, the constriction 1*g* is parallel to the rolls 8, 9, 10 and 11 when the rack 7 is supported by the tank 1 in working position. The constriction 1*g* has a length at least equal to that of the rolls 8, 9, 10 and 11 and extends over the full length of each of these rolls. The entry rolls 8 are disposed above the constriction 1*g* when the rack 7 is positioned in the tank 1. The height of that portion of the rack 7 which projects into the tank 1 when the rack 7 is in working position is such that this portion of the rack 7 extends over only part of the height of the tank 1.

The guide 13 has an upper edge 13*a* which must lie in the small enlargement 1*h* below the spray nozzle 3*b* when the rack 7 is mounted on the tank 1 in working position. If the guide 13 were rigid with the rack 7, the upper edge 13*a* of the guide 13 would catch at the upper edge of the spray nozzle 3*b*, i.e., at the constriction 1*g*, upon removal of the rack 7 from the tank 1. To avoid this, the guide 13 is mounted on the support 7*b* of the rack 7 for pivotal movement about a pivot 14.

Two cams 15 are secured to the guide 13 and embrace the pivot 14. At least one torsion spring 16 having a pair of legs 16*a* and 16*b* surrounds the pivot 14. The leg 16*a* of the spring 16 bears against the guide 13 while the leg 16*b* bears against a pin 7*a* mounted on the rack 7. The spring 16 is arranged to urge the guide 13 to an inoperative position in which the guide 13 is pivoted inward towards the interior of the rack 7, that is, towards the rolls 10 and 11. In the inoperative position of the guide 13, which is shown in FIG. 2, the guide 13 is oriented in such a manner that it is unable to direct the photographic material 2 from the transporting rolls 10 to the deflecting rolls 11.

Figure 2:
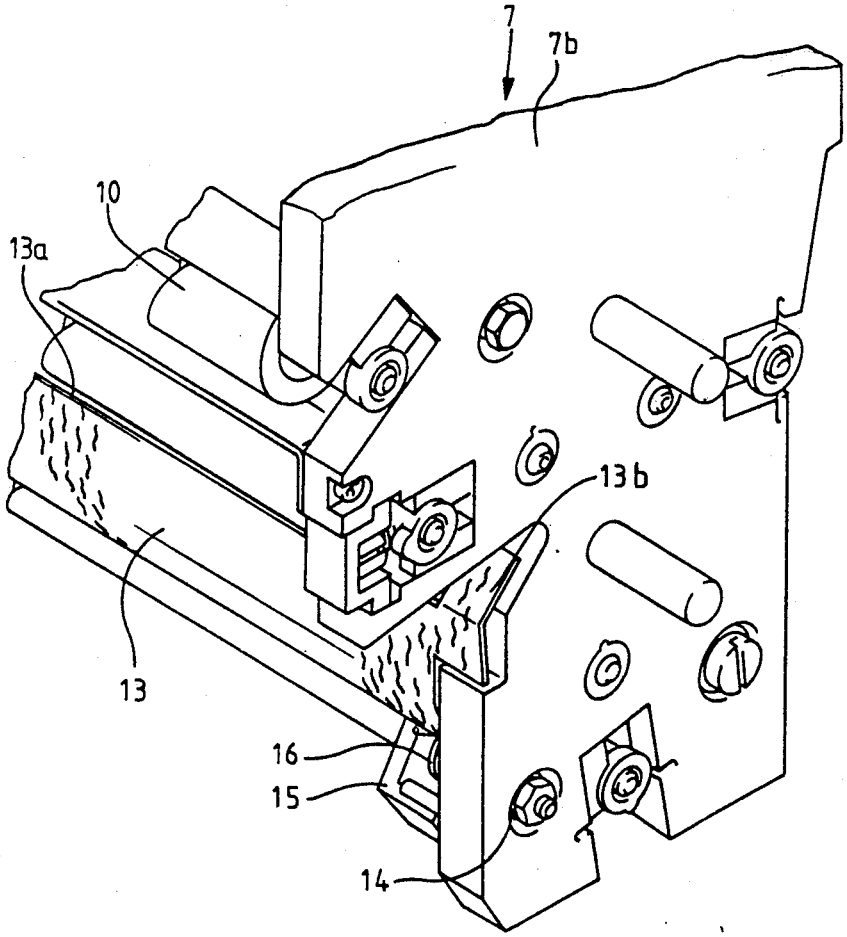
FIG. 2 is a fragmentary perspective view of the rack of FIG. 1.

When the rack 7 is inserted in the tank 1 with the guide 13 in the inoperative position of FIG. 2, the guide 13 is able to pass through the constriction 1*g* and by the nozzle 3*b* since the guide 13 is swung away from the free upper end of the container wall 1*e*. At least one of the cams 15 is formed with an inclined surface 15*a* and this inclined surface 15*a* comes into abutment with an inclined surface 1*j* situated inside the tank 1 upon insertion of the rack 7 into the tank 1. When the inclined surface 15*a* of the guide 13 abuts the inclined surface 1*j* within the tank 1, the guide 13 is pivoted counterclockwise in FIG. 1 from the inoperative position of FIG. 2 to an operative position illustrated in FIG. 1. Thus, the guide 13 is pivoted outward towards the exterior of the rack 7 and away from the rolls 10 and 11. The level of the inclined surface 1*j* inside the tank 1 is selected such that the guide 13 is pivoted from the inoperative to the operative position after the guide 13 has cleared the constriction 1*g* and the nozzle 3*b*, that is, when the upper edge 13*a* of the guide 13 is located below the constriction 1*g* and the spray nozzle 3*b*. In the operative position, the guide 13 prevents the photographic material 2 from entering the enlargement 1*h* and travelling along the constricting element 5 past the deflecting rolls 11. Rather, the guide 13 then directs the photographic material 2 from the transporting rolls 10 towards the nip of the deflecting rolls 11.

Upon removal of the rack 7 from the tank 1, the spring 16 shifts the guide 13 in a clockwise direction, as seen in FIG. 1, as soon as the inclined surface 15*a* of the guide 13 is lifted away from the inclined surface 1*j* within the tank 1. The guide 13 thereupon returns to the inoperative position.

After an extended period of use, it can happen that the spring 16 undergoes fatigue and is no longer able to pivot the guide 13 to the inoperative position when the rack 7 is removed from the tank 1. In order to permit removal of the rack 7 from the tank 1 under such circumstances, tabs 13*b* are formed at the two ends of the guide 13 to the sides of the path of travel of the photographic material 2. The tabs 13*b* are inclined towards the interior of the rack 7, that is, towards the transporting rolls 10. When the rack 7 is mounted in the tank 1, the two tabs 13*b* are located to the sides of the spray nozzle 3*b* and contact the container wall 1*e* in the region of the latter which forms the constriction 1*g*. Accordingly, upon lifting of the rack 7 from the tank 1, the guide 13 is urged towards the interior of the rack 7 and the rolls 10 and 11 via the tabs 13*b*, especially when the spring 16 is fatigued, so that the guide 13 can be moved through the constriction 1*g* without difficulty.

Without further analysis, the foregoing will so fully reveal the gist of the present invention that others can, by applying current knowledge, readily adapt it for various applications without omitting features that, from the standpoint of prior art, fairly constitute essential characteristics of the generic and specific aspects of the instant contribution to the art and, therefore, such adaptations should and are intended to be comprehended within the meaning and range of equivalence of the appended claims.

What is claimed is:

1. An arrangement for processing photosensitive material, particularly for wet processing running lengths of photographic material, comprising a treatment vessel for the photosensitive material; means defining a path for the photosensitive material and designed to be removably mounted in said vessel, said path defining means including a support and a guide mounted on said support for movement between an inoperative position and an operative position in which said guide is arranged to direct the photosensitive material along said path; means urging said guide to said inoperative position; and cooperating first and second means on said guide and in said vessel, respectively, for moving said guide from said inoperative position to said operative position upon insertion of said support in said vessel.

2. The arrangement of claim 1, wherein said guide is pivotally mounted on said support.

3. The arrangement of claim 1, further comprising means defining a constriction in said vessel, said vessel having an enlargement beyond said constriction, and at least a portion of said guide being disposed in said enlargement when said support is mounted in said vessel, said first and second means being arranged to move said guide from said inoperative to said operative position after said portion of said guide has cleared said constriction.

4. The arrangement of claim 1, wherein said urging means comprises a spring.

5. The arrangement of claim 1, wherein said first means comprises an inclined surface and said second means comprises a control surface arranged to abut said inclined surface upon insertion of said support in said vessel.

6. The arrangement of claim 1, wherein said path defining means further comprises transporting rolls on said support, said guide being shifted towards said rolls in said inoperative position and away from said rolls in said operative position.

7. The arrangement of claim 6, further comprising means defining an elongated constriction in said vessel; and wherein said path defining means further includes a pair of rolls on said support for drawing the photosensitive material into said path, said rolls having a predetermined length, and said constriction being generally parallel to said rolls when said support is mounted in said vessel and having a length at least equal to said predetermined length, said pair of rolls being located before said constriction when said support is mounted in said vessel.

8. The arrangement of claim 1, further comprising a container in said vessel, and means for admitting fluid into said container, said container being provided with at least one outlet for the fluid; and wherein said first and second means are arranged to move said guide from said inoperative to said operative position when said guide has cleared said outlet.

9. The arrangement of claim 8, wherein said vessel has an upper end and said path defining means is introducible into and removable from said vessel through said upper end, said container having an upper end defining a constriction in said vessel and said outlet being located adjacent to said upper end of said container.

10. The arrangement of claim 1, wherein said guide is provided with means for shifting said guide from said operative to said inoperative position upon removal of said support from said vessel.

11. The arrangement of claim 10, wherein said shifting means comprises at least one tab which is mounted on said guide laterally of said path.

12. The arrangement of claim 11, wherein said path defining means further includes transporting rolls on said support, said tab being inclined towards said rolls.

13. The arrangement of claim 11, further comprising means defining a constriction in said vessel; and wherein said tab is disposed adjacent to said constriction defining means when said support is mounted in said vessel and said guide is in said operative position.

14. The arrangement of claim 1, wherein said path has a first portion along which the photosensitive material travels in a first direction and a second portion downstream of said first portion along which the photosensitive material travels in a different second direction, said path defining means further including a pair of transporting rolls along said first portion of said path and a pair of deflecting rolls between said first and second portions of said path, said guide being disposed between said transporting and said deflecting rolls.

15. The arrangement of claim 14, wherein said vessel has an upper end and said path defining means is introducible into and removable from said vessel through said upper end, said vessel having a predetermined height and said path defining means extending from said upper end into said vessel for only a portion of said predetermined height when said path defining means is mounted in said vessel and said guide is in said operative position.

16. The arrangement of claim 1, wherein said guide is made of sheet material.

* * * * *